US007571581B2

(12) United States Patent
Covarrubias

(10) Patent No.: US 7,571,581 B2
(45) Date of Patent: Aug. 11, 2009

(54) CONCRETE PAVEMENT SLABS FOR STREETS, ROADS OR HIGHWAYS AND THE METHODOLOGY FOR THE SLAB DESIGN

(75) Inventor: Juan Pablo Covarrubias, Santiago (CL)

(73) Assignee: Inversiones Yuste S.A. (CL)

( * ) Notice: Subject to any disclaimer, the term of this patent is extended or adjusted under 35 U.S.C. 154(b) by 258 days.

(21) Appl. No.: 11/350,764

(22) Filed: Feb. 10, 2006

(65) Prior Publication Data

US 2007/0094990 A1 May 3, 2007

(30) Foreign Application Priority Data

Oct. 12, 2005 (CL) ..... 2684-2005

(51) Int. Cl.

| | |
|---|---|
| ***E04B 1/18*** | (2006.01) |
| ***E04B 1/00*** | (2006.01) |
| ***E01C 7/00*** | (2006.01) |
| ***E01C 11/00*** | (2006.01) |
| ***E01C 3/00*** | (2006.01) |

(52) U.S. Cl. ..... 52/741.1; 52/414; 404/17; 404/27; 404/47

(58) Field of Classification Search ..... 52/414, 52/741.1; 404/17

See application file for complete search history.

(56) References Cited

U.S. PATENT DOCUMENTS

| | | | | |
|---|---|---|---|---|
| 1,436,896 | A * | 11/1922 | Newell | 404/40 |
| 1,991,931 | A * | 2/1935 | Kling et al. | 404/17 |
| 3,022,713 | A * | 2/1962 | Friberg | 264/34 |
| 4,653,956 | A * | 3/1987 | Lang | 404/28 |
| 6,409,423 | B1 * | 6/2002 | Li | 404/49 |
| 6,592,289 | B1 * | 7/2003 | Weander | 404/74 |
| 6,688,808 | B2 * | 2/2004 | Lee | 404/40 |
| 6,745,532 | B1 * | 6/2004 | Vazquez Ruiz del Arbol | 52/414 |
| 2005/0220539 | A1 | 10/2005 | Yee | |

FOREIGN PATENT DOCUMENTS

| | | |
|---|---|---|
| ES | 2149103 | 10/2000 |
| WO | WO 00/01890 | 1/2000 |
| WO | 0212630 | 2/2002 |

OTHER PUBLICATIONS

Structural Design—Methods. Aug. 24, 2004. Washington Asphalt Pavement Association. Jan. 14, 2008. <http://web.archive.org/web/*/http://www.asphaltwa.com/wapa_web/modules/06_strutural_design/06_methods.htm>.*

Design Catalog—Introduction. Oct. 10, 2004. Washington Asphalt Pavement Association. Jan. 14, 2008. <http://web.archive.org/web/*/http://www.asphaltwa.com/wapa_web/modules/10_design_catalog/10_introduction.htm>.*

* cited by examiner

*Primary Examiner*—Brain E. Glessner
*Assistant Examiner*—Branon C Painter
(74) *Attorney, Agent, or Firm*—Banner & Witcoff, Ltd.

(57) ABSTRACT

A concrete slab where the maximum width value of the slab Dx is determined by the lower measure between the distance D1 of the front wheels of a model loading truck or by the mean, and the distance D2 of a rear running gear of the same truck or the mean; the maximum slab length L is determined by the distance between the truck axles or the mean; and the thickness E is determined by the concrete resistance value, in view of anticipated traffic loads, the kind and quality of the base, and the ground type. The design methodology of this concrete slab allows for only one wheel or only one running gear of the truck to touch and move over the slab.

8 Claims, 8 Drawing Sheets

RESULTS :

| | ESTIMATED | MINIMUM | MAXIMUM |
|---|---|---|---|
| ACI FLATNESS F-NO. : | 24.4 | 21.5 | 27.3 |
| ACI LEVELNESS F-NO. : | 19.2 | 16.8 | 21.5 |

NOTE: For this sample size, 9 times out of 10, the actual F-number for the floor will fall between the Minimum and Maximum values shown.

$1 < a \leq 2$

Hiller and Springenschmid, 2004

$1 < a \leq 2$

CONCRETE PAVEMENT SLABS FOR STREETS, ROADS OR HIGHWAYS AND THE METHODOLOGY FOR THE SLAB DESIGN

INVENTION APPLICATION FIELD

The current invention refers to a concrete slab for paving roads, highways and urban streets or similar, that presents improved dimensions in regard to the slabs of the previous art, resulting in a thinner pavement, and in consequence, cheaper than those known nowadays, and with a new slab design methodology, different from the traditional ones. For this type of pavement, slabs are supported on a traditional base for this kind of pavement which may be granular, treated with cement or treated with asphalt. The current invention is for new concrete pavements and does not consider the repairing of old pavements with superposed concrete layers.

PREVIOUS ART COMMENTS

The traditional systems employed until now, consider the width of pavement slabs equal to a lane width and the long dimension equal to the lane width or 6 meters long. These dimensions resulted in loads being applied at both slab edges simultaneously, inducing tensile stresses on the slabs surfaces where they are warped. Such warping is normal and the slabs are always curled with the edges upwards. These applied loads are the main cause for cracking due to the concrete pavement stress.

The current invention considers shorter slabs which will never be loaded at both edges simultaneously. So the loading system is different. This new loading system always supports the load on the ground, when the wheels move over the rocking slab. There will never be more than one running gear over a slab. This concept produces smaller tensions, in slabs of smaller dimensions than the front and rear axles of trucks, allowing a reduction of the thickness necessary to support the trucks. This thickness reduction lowers the initial costs.

Generally, concrete slabs for roads, highways and urban streets have dimensions that normally are of a one lane width, in general, 3500 mm wide and 3550 to 6000 mm long. In order to support the load of heavy trucks, that generate increased tensions and requirements to those slabs, road civil engineers must design slabs where the thickness is very important in order to prevent cracking. A lot of these designs use reinforcements, wire mesh or steel, assuring the slab durability, but increasing the slab cost significantly.

The document ES 2149103 (Vásquez Ruiz Del Árbol), dated on Jul. 7, 1998 reveals a articulated load transfer procedure between concrete slabs in situ where joints are formed, placing at the job site joint lines, a single device made with plastic mesh considering a shear and bending scheme prepared at the shop previously. In this way, the shrinking phenomenon is employed to obtain an alternative indentation along the joints of adjacent slabs forming a continuous concrete slab which will be able to form a linkage of a hinge type between them. The procedure is complemented with a concrete separating element that makes easy the cracking formation and prevents water to come to the level space, and that may be hold in place with the mentioned device. The invention, mentioned in this document, is applicable to concrete pavements for roads, highways and warehousing in harbor areas, and it allows designing pavements without using bases and sub bases.

The document ES 2092433 (Vásquez Ruiz Del Árbol), dated on Nov. 16, 1996, reveals a procedure to build concrete pavement for roads and airports. A sliding formwork is placed on a spreader (3) to form inner holes (2) in a slab on grade (1), the fluid is grouted (4), preferably bentonite slurry or soaped wet air, in each watertight hole formed by the formworks, pouring the fluid at an adequate volume of flow and pressure so, once the formwork are stripped, those holes are supported by the fluid grouted on them, closing the concrete pores and proportioning the support for fresh concrete in the small tunnels; then the necessary procedures are made in order to form the concrete. The invention mentioned in this document allows saving concrete of the roadbed upper layer or of the base layer and obtains a rigid roadbed for every class of roads as highways, roads, ways and airports.

The document WO 2000/01890 (Vásquez Ruiz Del Árbol), dated on Jan. 13, 2000 reveals a articulated load transfer procedure between concrete slabs in situ where joints are formed, placing at the job site joint lines, a single device made with plastic mesh considering a shear and bending scheme prepared at the shop previously. In this way, the shrinking phenomenon is employed to obtain an alternative indentation along the joints of adjacent slabs forming a continuous concrete slab which will be able to form a linkage of a hinge type between them. The procedure is complemented with a concrete separating element that makes easy the cracking formation and prevents water to come to the level space, and that may be hold in place with the mentioned device. The invention, mentioned in this document, is applicable to concrete pavements for roads, highways and warehousing in harbor areas, and it allows designing pavements without using bases and sub bases.

ABSTRACT OF THE INVENTION

The current invention refers to a concrete slab for paving roads, highways and urban streets or similar, that presents improved dimensions in regard to the slabs of the previous art, resulting in a thinner pavement, and in consequence, cheaper than those known nowadays, and with a new slab design methodology, different from the traditional ones. For this type of pavement, slabs are supported on a traditional base for this kind of pavement which may be granular, treated with cement or treated with asphalt. The current invention is for new concrete pavements and does not consider the repairing of old pavements with superposed concrete layers.

This invention is applicable to concrete slabs on grade for paving roads, highways, and streets, where the critical elements are the slabs dimensions and the distances between the wheels of a loaded truck and the number and kinds of passing vehicles.

FIGURES DESCRIPTION

The accompanying figures, are included to give more comprehension to the invention, and are incorporated to and form part of this description. They illustrate the invention, and together with the description, explain the invention.

FIG. 1 shows the measured curling on an industrial floor slab 150 mm thick, 4 meters long. The slab is supported on the central circle, the edges are in cantilever. The corners are four times more deformed than the center of the edges. (Holland 2002)

Figure 4:
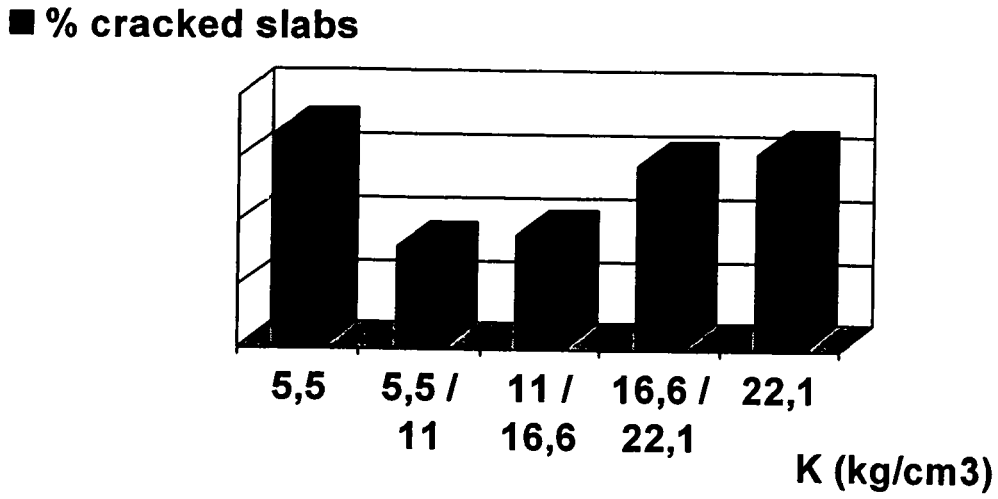

FIG. 4 shows the effect of base stiffness on amount of cracking in slabs. A medium stiffness is better than very stiff or very soft. The optimum is between CBR 30 to 50% (Armanghani 1993).

Figure 5:
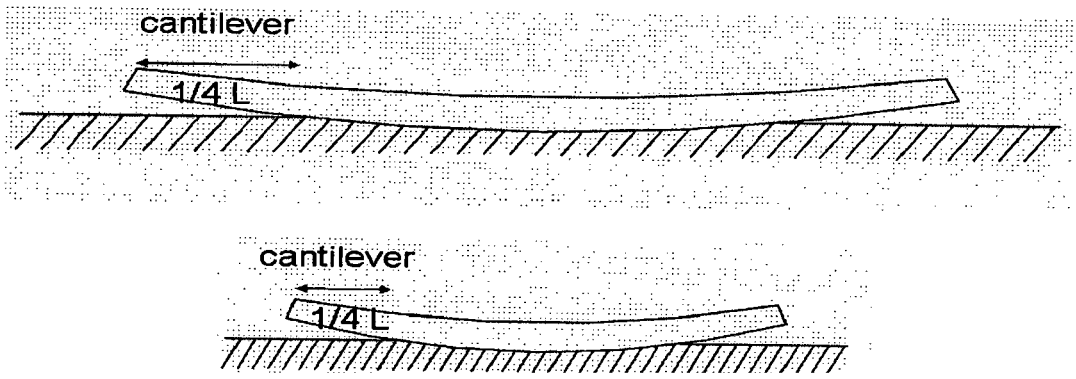

FIG. 5 shows that shorter slabs have shorter cantilevers than longer slabs, and therefore smaller tensile stresses on the top.

Figure 6:
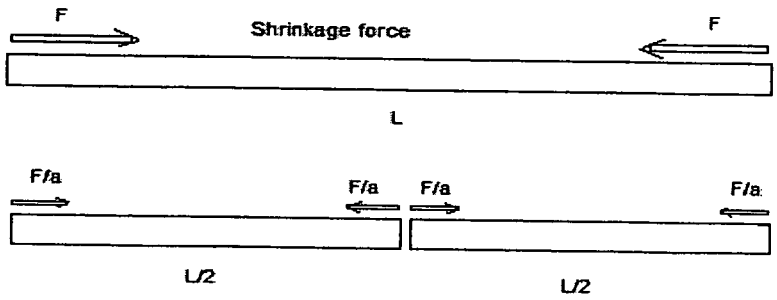

FIG. 6 shows that shorter slabs have smaller surface force and therefore, smaller curling.

Figure 7:
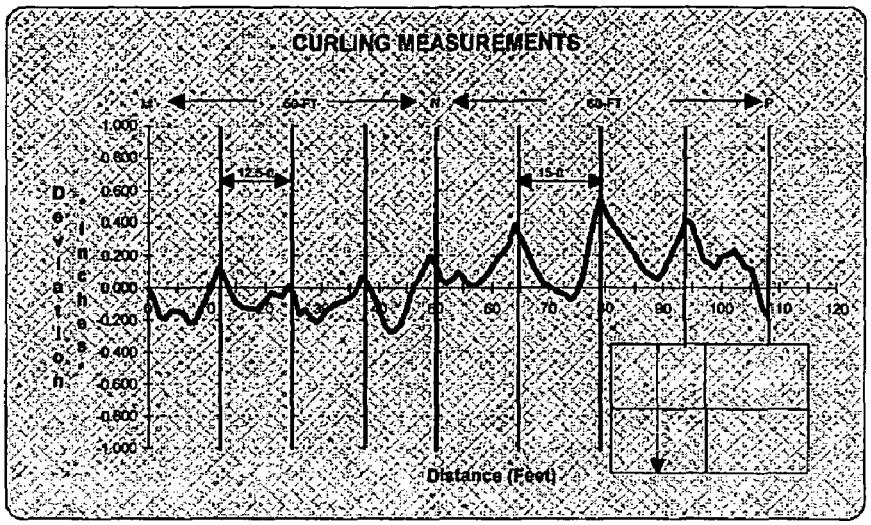

FIG. 7 shows that measured curling on an industrial floor. It shows that short slabs have less curling than long slabs. (Holland 2002)

Figure 8:
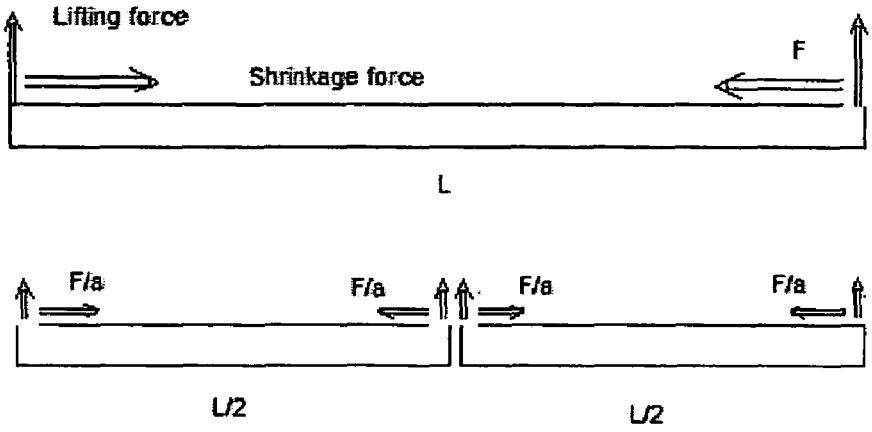

FIG. 8 shows schematic forces, including curling lifting forces, in a concrete slab.

Figure 9:
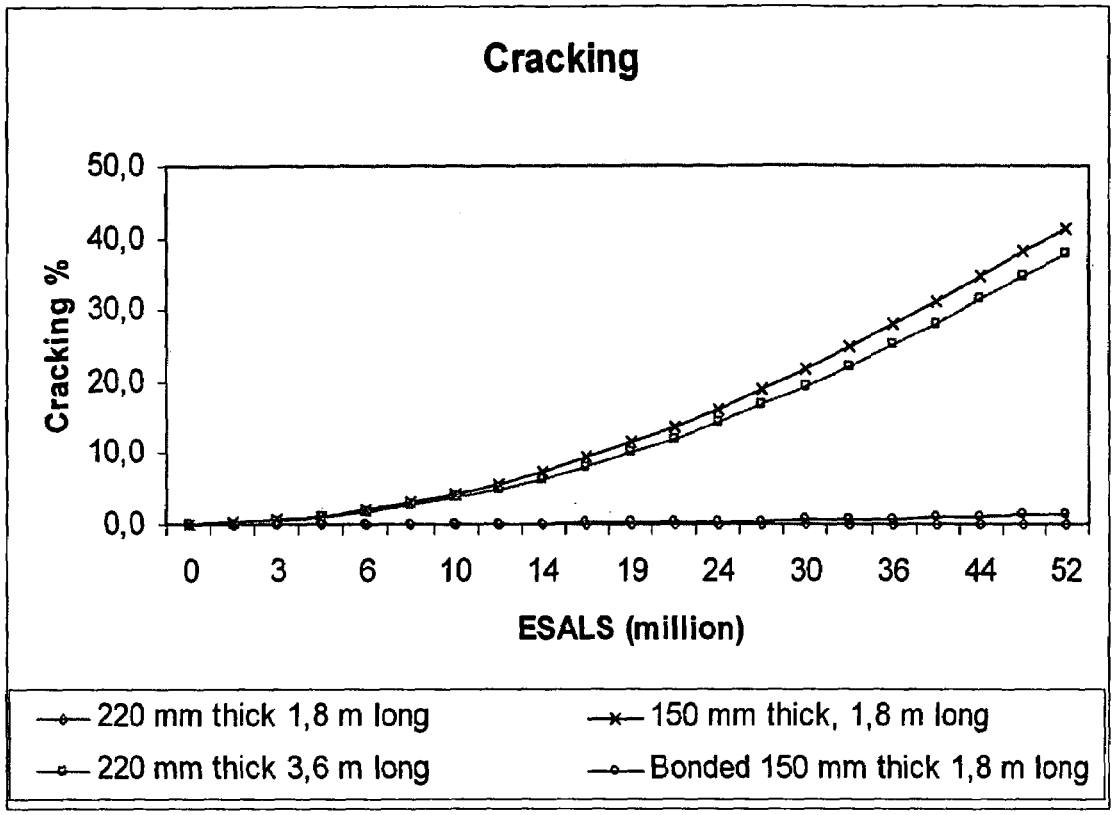

FIG. 9 shows the performance for cracking in concrete pavements with 150 and 250 mm thick and 1,800 and 3,600 mm long using HDM 4 performance models.

Figure 10:
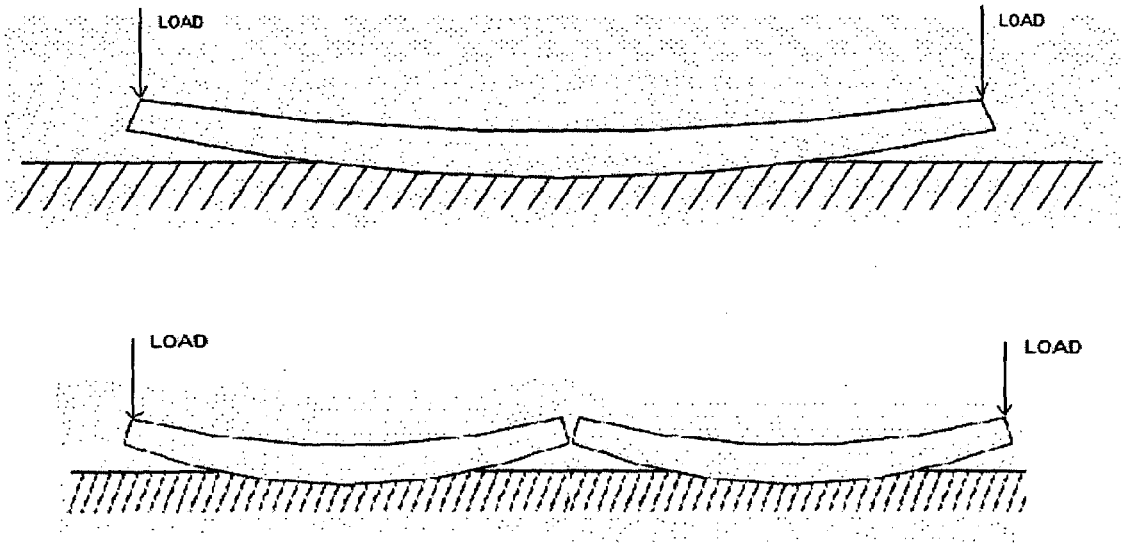

FIG. 10 shows the effect of slab length on position and effect of the loads. Each load on the diagram represent the front and back axles of a vehicle.

Figure 11:
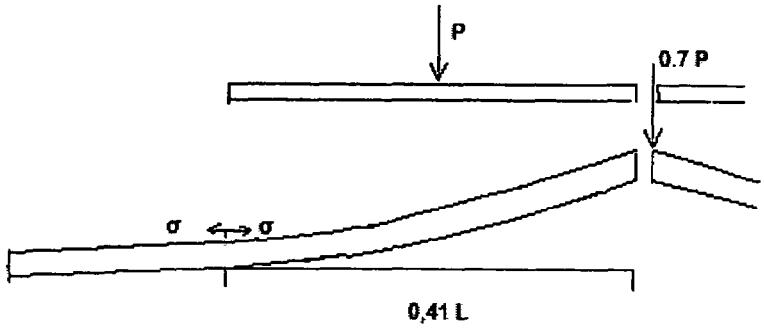

FIG. 11 shows the position and loading of a short slab when traffic load is on the edge and the slab rocks.

Figure 12:
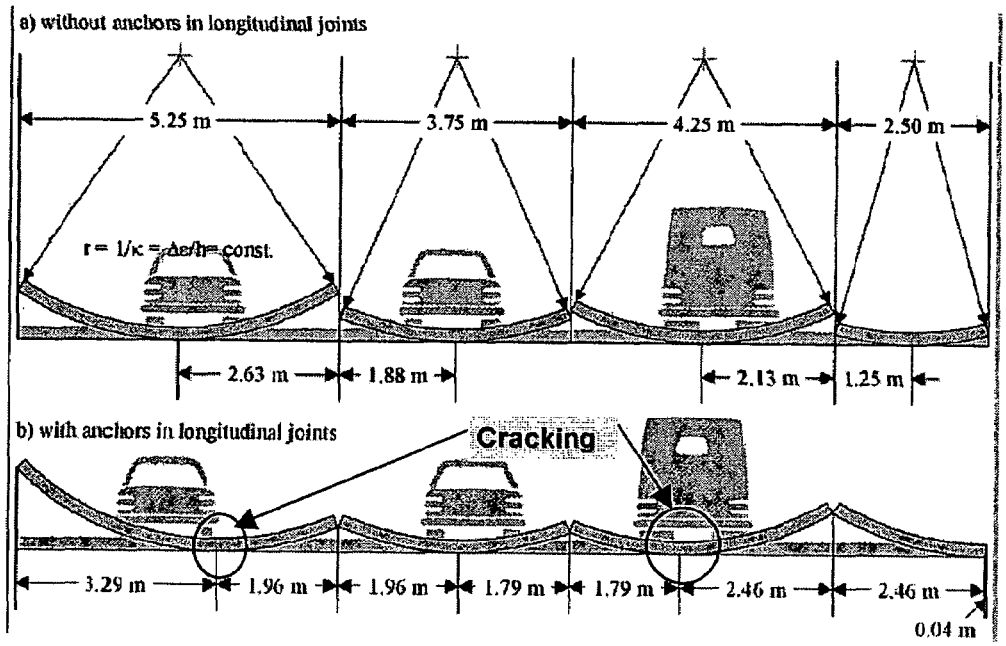

FIG. 12 shows the performance (cracking) of concrete slabs with and without tie bars. If slabs are allowed to rock the cantilevers are shorter and the cracks reduced.

Figure 13:
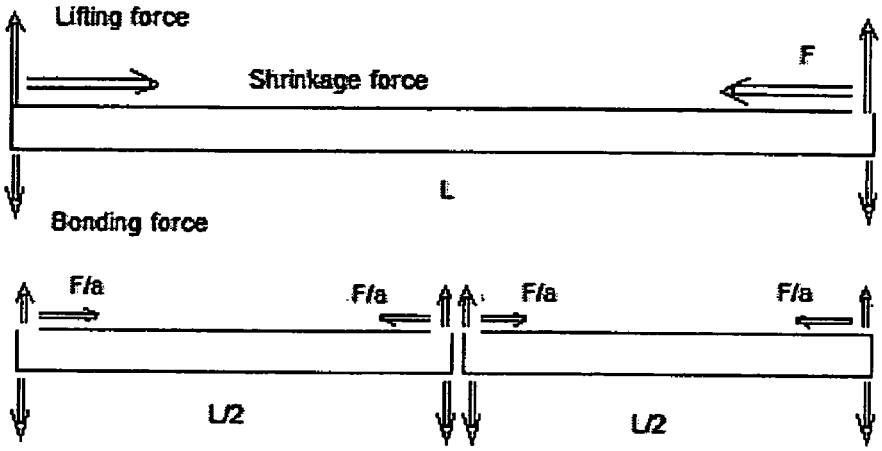

FIG. 13 shows the schematic forces with bonding of the slab to the base. Shorter slabs have smaller lifting loads so bonding is more effective.

Figure 14:
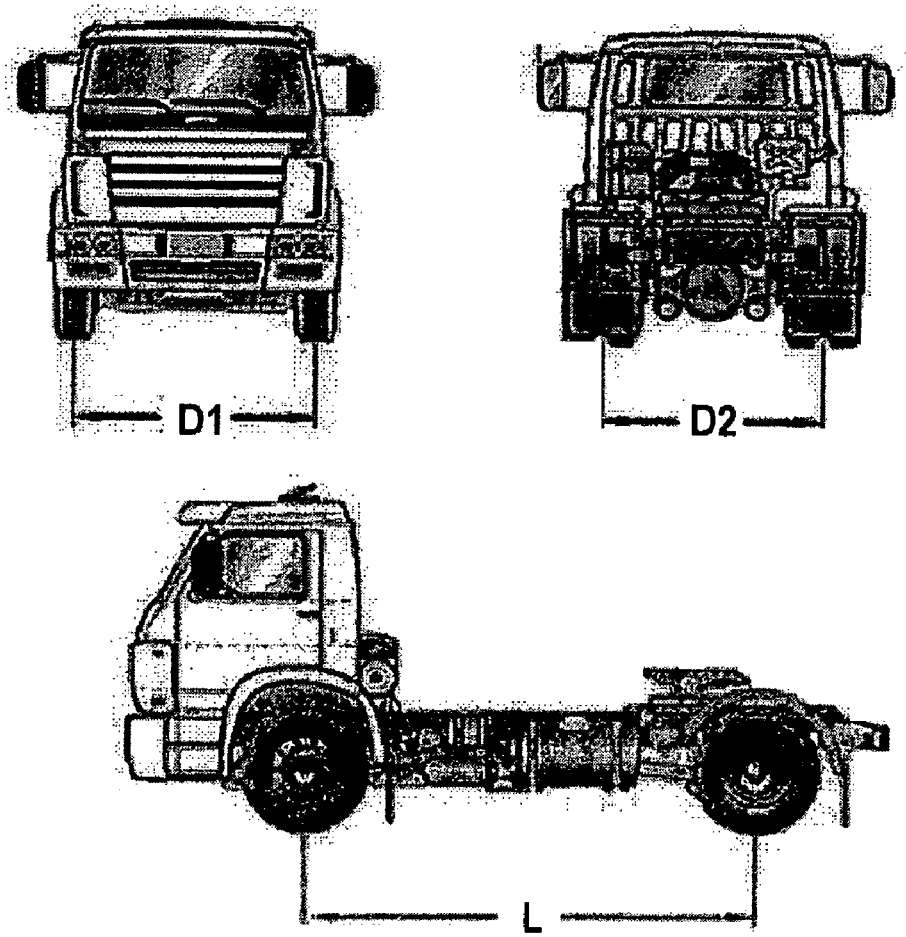

FIG. 14 shows the measures of a heavy load truck used in the calculus methodology of the current invention.

Figure 15:
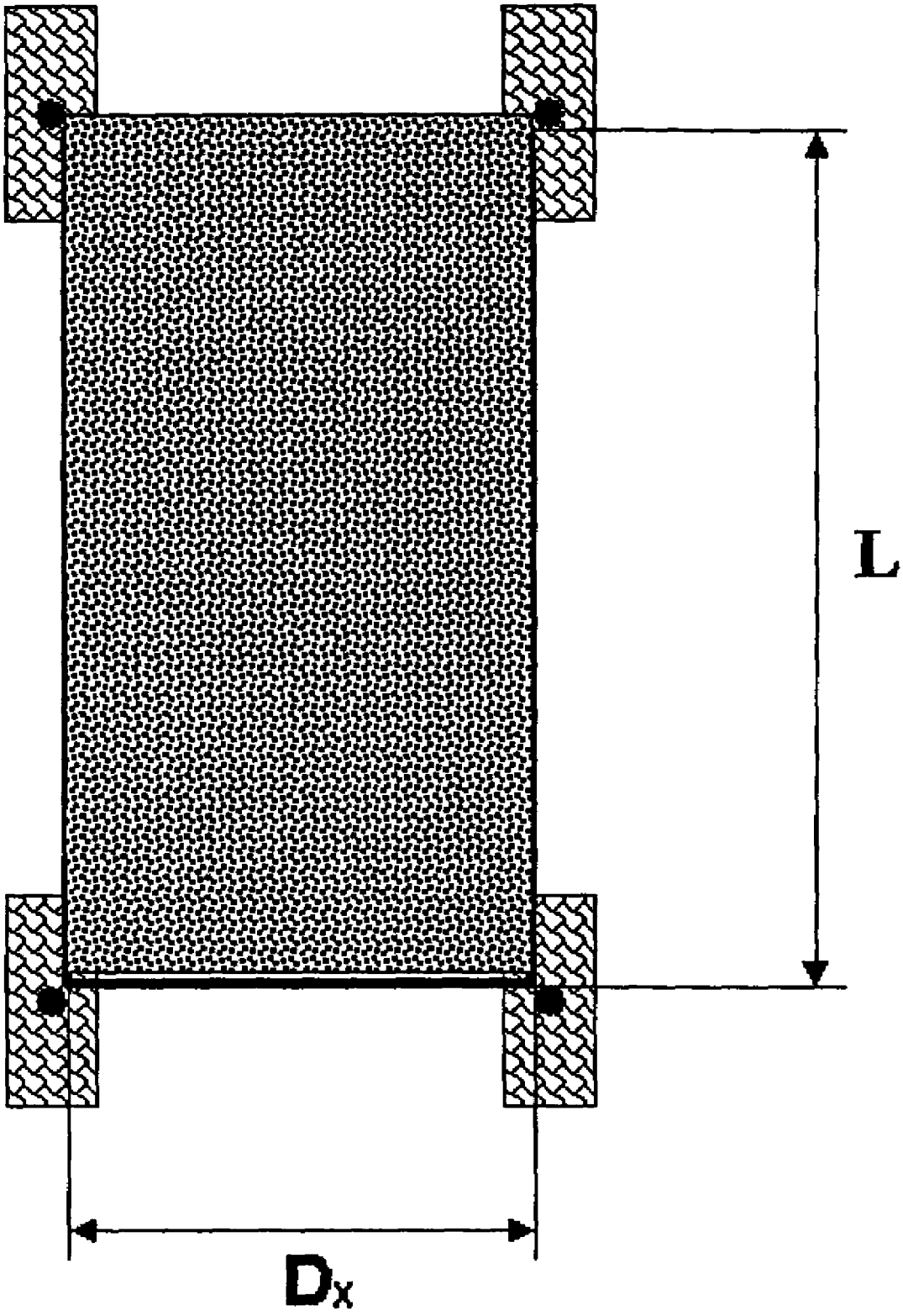

FIG. 15 shows the maximum allowed measures of a slab on grade for the current invention.

Figure 16:
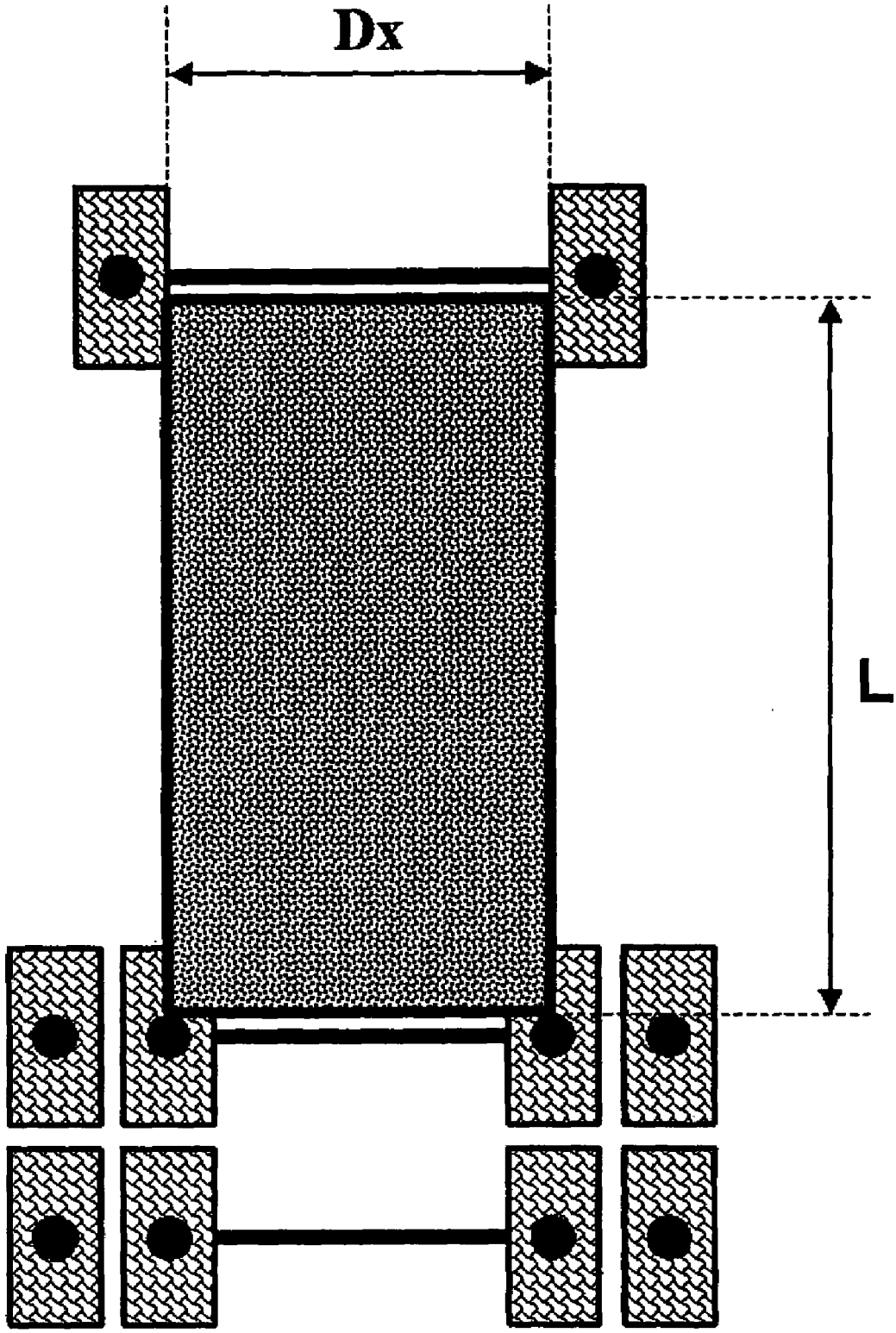

FIG. 16 shows the maximum measures allowed of a slab on grade for the current invention, over a mean or model truck with one running gear.

INVENTION DESCRIPTION

The current invention refers to a concrete slab for paving roads, highways and urban streets or similar, that presents improved dimensions in regard to the slabs of the previous art, resulting in a thinner pavement, and in consequence, cheaper than those known nowadays, and with a new slab design methodology, different from the traditional ones. For this type of pavement, slabs are supported on a traditional base for this kind of pavement which may be granular, treated with cement or treated with asphalt. The current invention is for new concrete pavements and does not consider the repairing of old pavements with superposed concrete layers.

This invention is applicable to concrete slabs on grade for paving roads, highways, and streets, where the critical elements are the slabs dimensions and the distances between the wheels of a loaded truck and the number and kinds of passing vehicles.

When analyzing the performance of concrete pavements and its relation to curling, there are some thoughts that can be discussed. In Chile there was a very bad experience of unbonded slabs over cement treated bases. A polyethylene sheet was placed between the slab and the CTB. The cracking of these pavements started in about eight years, while in pavements of the same contract over granular bases, with the same polyethylene under the concrete, the cracks started after fifteen years. This performance shows the effect of bonding, rigidity of the base and length of slabs. The following thinking tries to explain this performance and optimize concrete pavement design.

Figure 1:
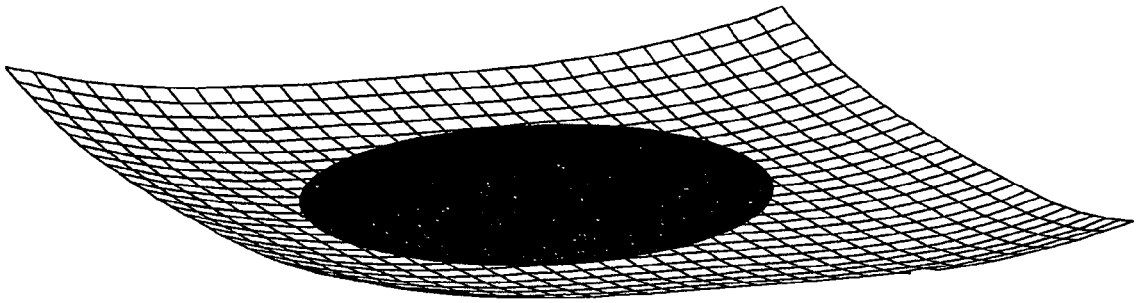
Figure 2:
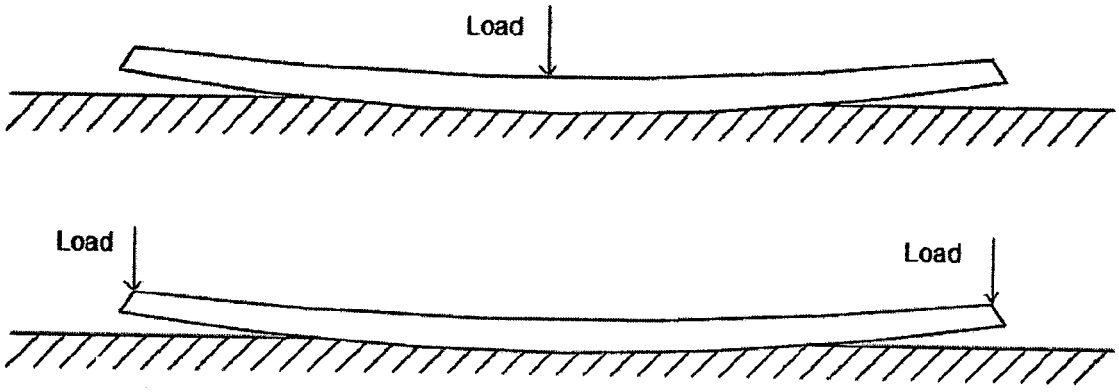
FIG. 2 shows the load critical forms on slabs of conventional measures.
Figure 3:
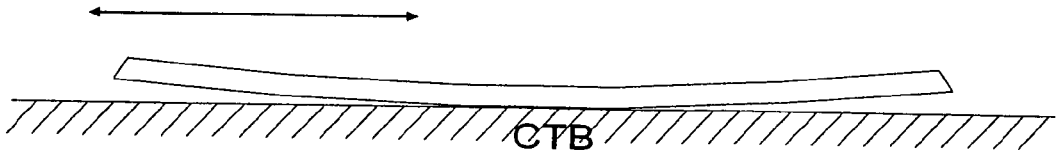
FIG. 3 shows the effect of stiffness of the base on cantilever length on debonded concrete slabs.

The pavement slabs are supported by the base. When the slab curls, if the base is stiff, it will not sink on it and the central area of support will be small and the cantilever long (FIGS. 1, 2 and 3). With the loads at the edges, this will produce high tensile stresses on the surface of the slab and top down cracks. If the base is soft, the slab will sink on it leaving a shorter cantilever and lower stresses with the same loading. For this case, the ideal support rigidity is with a stiffness of CBR (Soil Resistance Test) 30 to 50% (FIG. 4).

A base that is too soft with the load at the center, will produce tensile stresses at the bottom of the slab and bottom up cracks. This is explained because the slab will be wholly supported and the stresses will be induced by the deformation of the slab over a deformable support (FIG. 4). This same effect is induced if the slabs are warped downward. This is the original thought on calculating the stresses with the old design methods, before the curling up phenomena was known.

This suggests that the optimal material to use as base material would be with CBR between 30 and 50% when the slabs are curled upwards. In Chile, the most durable concrete pavements (more than 70 years on a high traffic road) were built over bases with CBR 30%.

The needed stiffness of the base could be different if the slabs are flat and with the bottom up crack possibility.

Another point to have into account is that heavy traffic normally runs at night, when the slabs are curled upwards. This would make us think that the upward curling should be the main consideration for design of a rural pavement.

If the slab curls upward leaving a cantilever of a fourth of its length, then a shorter slab will have a shorter cantilever (FIG. 5). Therefore, shorter slabs will have reduced tensile stresses on the top than longer slabs.

Also, shorter slabs have reduced curling. The curling is produced by an asymmetrical force on the surface of the slab (FIG. 6). This force is produced by drying and thermal differential shrinkage on the surface of the concrete. This force induces the construction or built up curling.

The drying shrinkage curling is due to the hydraulic difference between the top and the bottom of the slab. The slab is always wet at the bottom, as the humidity of the earth condenses under the pavement, and it is most of the time dry on the surface.

This humidity gradient produces an upward curling. The residual upward curling for the slab with zero temperature gradient was measured in Chile on real pavements, and was equivalent to a thermal gradient of 17.5° C. with the top colder. The maximum positive gradient measured at midday, when the slab was hot at the surface, was 19.5° C. This means that the slab never got flat on the ground. It always presented an upward curling, being maximum at night time, when the built in and the temperature gradient with the top cold are added. This gives the maximum upward curling of a slab, and normally is produced at early hours in the morning, before the sun comes out.

Construction is important to reduce inbuilt hydraulic curling. A good curing to prevent surface water loss when the concrete is not stiff enough will reduce curling. Allowing some drying of the concrete from the bottom surface of the slab, by not using impermeable materials under the slab or not saturating the base before placing the concrete, also reduces humidity curling. Care should be taken on temperature of the base when placing the concrete. Maybe some watering should be done to reduce the temperature of the base.

The main thermal shrinkage is produced during construction. When the concrete is placed during the hot hours of the day, the concrete on the surface of the slab will be hotter and harden with a longer surface because of its higher temperature than the bottom surface. It will also harden first. When the temperature comes down to normal working temperature, the top of the slab will reduce its length more than the bottom part, and induce a superficial force that produces the upward curling. Placing the concrete in the afternoon and evening, will reduce high surface temperatures and reduce curling due to thermal differentials.

These forces induced by drying and temperature shrinkage of the surface are dependant of the slab length. For longer slabs, the curling force will be bigger, and so the curling and the cantilever.

It has been seen that construction timing and curing are big contributors to curling of concrete slabs, together with length.

Normally, on 3.5 to 5 meters long slabs, the front and rear axles load the slabs at both edges simultaneously (FIG. 10). This loading induces the traffic surface tensile stresses to the pavement when it is curled upwards, inducing top down cracks. These tensile stresses at the top are due to the moment produced in the cantilever part of the slab. In this situation, it is very important that the load transfer, which allows more than one slab taking this loading. The slabs collaborate and reduce the stresses on each slab.

FIG. 9 shows the performance in cracking of a pavement varying only the thickness and the slab length, all other design parameters were kept constant. The models used to analyze this performance were the HDM 4 models developed from the Ripper 96 models. It can be seen that the cracking performance of a slab 3.8 meters long and 220 mm thick is similar to a slab 1.8 meters long and 150 mm thick. If the slab is bonded to a CTB, the performance is much better.

This model over dimension slabs since it induces load on edges.

If slabs are short, of a length where the front and rear axles will never load the edges simultaneously (FIG. 10), the configuration of the loading and the rocking of the slabs change the stresses configuration within the slab. Only one set of wheels will move over the slab and the slab will rock in a way that the load will always be touching the ground, therefore well supported, and the slab will have no stresses produced by the cantilever and the loading. In rocking, the slab will be lifted and the weight of the slab will induce tensile stresses at the surface (FIG. 11). In this case the stresses are produced by the slab's own weight when it rocks. Now, the main loading will depend on the geometry of the slab and not on the traffic loading. If the slabs are curl upward and allowed to rock, the stresses will be reduced, assuming the stiffness of the base is optimal.

The following Table 1 shows the geometry and the stresses induced by the weight of the concrete of the slab. It was assumed that the cantilever is 0.41 times the length of the slab and 70% of load transfer, when de traffic load is applied at the edge of the slab and the slab lifts up the other end and the next slab. It also shows the axle load needed to lift the slab.

TABLE 1

Geometry, stresses, and needed axle weight to induce stresses (σ) because of own weight of the slab. Several easy assumptions were used to simplify the model.

| L (cm) | height (cm) | width (cm) | Moment (kg*cm) | σ (MPa) | Axle load to lift the slab (kg) |
|---|---|---|---|---|---|
| 500 | 25 | 350 | 3076 | 30 | 10767 |
| 500 | 20 | 350 | 2461 | 37 | 8613 |
| 500 | 15 | 350 | 1846 | 49 | 6460 |
| 500 | 12 | 350 | 1477 | 62 | 5168 |
| 500 | 10 | 350 | 1230 | 74 | 4307 |
| 500 | 8 | 350 | 984 | 92 | 3445 |
| 450 | 25 | 350 | 2492 | 24 | 9690 |
| 450 | 20 | 350 | 1993 | 30 | 7752 |
| 450 | 15 | 350 | 1495 | 40 | 5814 |
| 450 | 12 | 350 | 1196 | 50 | 4651 |

TABLE 1-continued

Geometry, stresses, and needed axle weight to induce stresses (σ) because of own weight of the slab. Several easy assumptions were used to simplify the model.

| L (cm) | height (cm) | width (cm) | Moment (kg*cm) | σ (MPa) | Axle load to lift the slab (kg) |
|---|---|---|---|---|---|
| 450 | 10 | 350 | 997 | 60 | 3876 |
| 450 | 8 | 350 | 797 | 75 | 3101 |
| 400 | 25 | 350 | 1969 | 19 | 8613 |
| 400 | 20 | 350 | 1575 | 24 | 6891 |
| 400 | 15 | 350 | 1181 | 32 | 5168 |
| 400 | 12 | 350 | 945 | 39 | 4134 |
| 400 | 10 | 350 | 788 | 47 | 3445 |
| 400 | 8 | 350 | 630 | 59 | 2756 |
| 350 | 25 | 350 | 1507 | 14 | 7537 |
| 350 | 20 | 350 | 1206 | 18 | 6029 |
| 350 | 15 | 350 | 904 | 24 | 4522 |
| 350 | 12 | 350 | 724 | 30 | 3618 |
| 350 | 10 | 350 | 603 | 36 | 3015 |
| 350 | 8 | 350 | 482 | 45 | 2412 |
| 175 | 25 | 175 | 377 | 4 | 1884 |
| 175 | 20 | 175 | 301 | 5 | 1507 |
| 175 | 15 | 175 | 226 | 6 | 1131 |
| 175 | 12 | 175 | 181 | 8 | 904 |
| 175 | 10 | 175 | 151 | 9 | 754 |
| 175 | 8 | 175 | 121 | 11 | 603 |
| 120 | 25 | 120 | 177 | 2 | 886 |
| 120 | 20 | 120 | 142 | 2 | 709 |
| 120 | 15 | 120 | 106 | 3 | 532 |
| 120 | 12 | 120 | 85 | 4 | 425 |
| 120 | 10 | 120 | 71 | 4 | 354 |
| 120 | 8 | 120 | 57 | 5 | 284 |

For thinner slabs, the loads needed to lift it are smaller than for thicker slabs. Light traffic will lift the edge of the slabs that produces the tensile stresses. As the number of lighter vehicles is larger than the number of heavy vehicles, the number of fatigue replications is increased for thinner slabs.

Having this as one mechanism of failure, the design should take into account the geometry of the slab. This geometry can be optimized by designing the slab length in accordance to the axle and tire distances of the most common trucks.

The width of half a lane also helps in taking the traffic loads near the center of the narrow lane, reducing the loading at the edges and reducing the cantilever in the transverse direction. A width of one third of a lane could take the traffic loads near the longitudinal joint, worsening the performance.

The lane width can be optimized. With three lanes per normal lane in width, with a non symmetrical design, a narrower central lane can be designed to keep the traffic loads at the center of the outer lanes.

The other load condition that must be looked after are the normal stresses for a flat slab due to bending over an elastic support. This condition produces bottom tensile stresses and bottom up cracking. The stresses should be checked in this situation, as they will be another limit for the thickness of the slab.

When the slab length is reduced, bellow a given length, the stresses produced by traffic loads change. For long slabs, load transfer helps in supporting the loading. For short slabs, load transfer adds the loading of the adjacent slab and increases stresses. This is shown in FIG. 11, where it can be seen that eliminating the load of the contiguous slab reduces the stresses. This can also be seen in FIG. 12, where the tie bars increase the cantilever and the cracking of the slabs, by reducing the possibility for the slab to rock and accommodate the loads in a less stressful position.

The curling forces tend to lift the edges of the pavement slab. This is due to a moment produced by the force located at the surface level and not at the neutral axis of the slab. Bonding of the slab produces a downward vertical force which compensates the curling moment. If this bonding vertical force is bigger than the curling lifting vertical force, the slab will stay flat on the base. If this is the case, there will be no cantilever and the top tensile stresses in the slab will be much smaller. Even if the edges lift up, the bonding forces will reduce the length of the cantilever, as the curling moment will have an inverse moment produced by the bonding force. The unbending will go under the slab up to the position where the curling upward force is the same as the bonding downward force.

Bonding of the slabs is beneficial for the performance of concrete pavements. This is more important with stiff bases, like materials treated with cement or asphalt.

With slabs half a lane wide and long, the design concepts change. With this geometry the stresses are mainly due to the own weight of the slab and the position of the tire loading, for curled upward slabs. Also the thickness should be checked by the stresses induced by flexion of flat or warped downward slabs over the base.

The short slabs curl much less than ordinary length slabs. Allowing the rocking of the slabs should reduce stresses in the pavement. If this is true, load transfer should not exist. This would design pavements with no steel bars within the slabs. Confinement to eliminate a possible drift and separation of the lanes can be achieved with curbs or by vertical steel pins on the outer edges of the slabs.

The invention considers the four bearing points of a truck, generated by the four bearing points of the wheels. FIG. 14 shows a truck with two front wheels and two pairs of rear wheels. Front wheels are separated at a distance D1 and the rear running gear is separated at a distance D2. The distance between the front axle and the first rear axle is L. The purpose is preventing that front wheels, or both pair of rear wheels, bear over the pavement simultaneously, so the slab shall have a maximum width given by the less between D1 and D2, to which the value Dx will be assigned. To prevent that one of the front wheels and one of the rear axles bear simultaneously on the slab, the slab must have a length smaller than L. As may be seen in FIG. 14, in this way, the slab will have a maximum width Dx and a maximum length of L, assuring that only one wheel bears on the slab when the truck moves over the road o highway.

In practice, the slabs will be larger than Dx and L measurements, so slabs cuts must be done at distances that allow generating slab dimensions that change the load effect of the vehicles or trucks axles, used as design reference. In a preferred execution of the current invention, cuts are sawed at 3 m in longitudinal sense and a longitudinal cut that diminishes the slab width at least at a measure equivalent to half a lane width. In the Chilean case, ideally slabs shall have 1.75 m long and 1.75 m width. Those measurements are not only the possible ones, but they present an example to better understand the system. At the present, this cut in normally done at a distance of 3.5 m to 6 m in transverse direction, allowing slabs of this length in the longitudinal sense and the width equal to a normal lane of 3.5 m width.

This dimensions allow the slab have a thickness E thinner than traditional one. Calculation for the thickness E is given by a stress analysis of the slab weight, load transfers, the ground support capacity, the concrete resistance, the curling conditions and the bearing area, the type and traffic volume.

Once the measures Dx, L and E are known, the ground shall be prepared for paving in order to put in place the necessary amount of concrete that shall fill the right lengthen rectangular parallelepiped that forms the pavement slab.

The minimum value of Dx width is longer than 50 cm, and alternately, the maximum dimension of the width is equivalent to half a normal lane. In the same manner, the minimum value of L length is longer than 50 m. When using a reference truck for the slab design, the maximum length may respond to 3 m or 3.5 m, depending on the distance between axles.

Moreover, the slab may be supported by a traditional base for concrete pavements; the support may be granular or treated with cement or treated with asphalt.

The slab dimensions may be obtained experimentally and compared with a design catalogue based on the performance measured by test spans, making easier the design.

As it was mentioned previously, the pavement span may be larger than the measures Dx and L, but by sawing, the spans may be cut to the wanted measures.

The mentioned dimensions would allow that only one wheel, or one running gear, be always bearing and moving over the slab.

The model truck or mean would have a pair of front wheels and a rear running gear, as can be seen in the FIG. 16. In this case, the distance L would be measured between the front axle and the first rear axle.

To design a slab using the current invention, the following methodology is proposed:

a) To determine a model or mean truck with a distance D1 between front wheels and a distance D2 between one running gear and a length L for the distance between the front axle and the first rear axle of this running gear;

b) To dimension the slab width at a distance Dx, which is smaller than the value of D1 and D2;

c) To dimension the slab length in a distance smaller than the value of the distance L between the front axle and the first rear axle of this running gear of the model truck, and d) To dimension the slab thickness for a distance E given by the concrete resistance value, considering the traffic loads, the kind and quality of the base and the ground type.

In the methodology of the current invention, the minimum value for Dx is longer than the 70 cm traditional large cement tile. The maximum dimension DX is equivalent to half a normal lane and the maximum dimension L corresponds to 3.0 m or 3.5 m.

Having an adequate calculus methodology, and based on a loading truck or mean, a design catalogue may be generated using the Dx, L and E dimensions, based on the performance measured on the test spans.

As an additional step to the methodology, the paving span may have bigger dimensions than Dx and L, and then, this span may be cut using a saw to the dimensions Dx and L or smaller.

The invention claimed is:

1. A method for producing concrete slabs pavements for streets, roads, highways and express highways wherein a base is prepared and concrete is poured on site to form the slab, the method comprising the following stages: a) providing a model truck with a distance D1 between front wheels, a distance D2 between a set of rear wheels, and a length L between the front and the first rear axle of the set of wheels; b) setting the width of the slab so that the width is smaller than the smallest of D1 and D2; c) setting the length of the slab so that it is smaller than the length L; d) setting the thickness of the slab to a value E based on a value of strength of the concrete; e) preparing the base, and f) pouring concrete in situ to form at least one parallelepiped slab having a width and length of the slab, or to form a parallelepiped section and subsequently cutting the section to form a plurality of slabs, each slab having a width not larger than the smallest of D1 and D2 and a length not larger than L; wherein at all times only one wheel or one set of wheels will touch and be supported by the slab.

2. A method according to claim 1, wherein the width of the slab is greater than 0.50 meters.

3. A method according to claim 1, wherein the length of the slab is greater than 0.50 meters.

4. A method according to claim 1, wherein the width of the slab is equivalent to half the lane width.

5. A method according to claim 1, wherein the length of the slab is not larger than 3.0 meters.

6. A method according to claim 1, comprising first forming a concrete section having a width larger than the smallest of D1 and D2 and a length larger than L and then cutting the concrete section to produce a slab having a width not larger than the smallest of D1 and D2 and a length not larger than L.

7. A method according to claim 1, comprising pouring the concrete section directly on site to form a rectangular parallelepiped.

8. A method for generating a design catalogue comprising preparing the concrete slabs as in claim 1, and cataloguing performance data measured in test sections of the concrete slabs base on the dimensions D1, D2, L and E.

* * * * *